US005513499A

United States Patent [19]

deRijke

[11] Patent Number: 5,513,499

[45] Date of Patent: May 7, 1996

[54] METHOD AND APPARATUS FOR CRYOPUMP REGENERATION USING TURBOMOLECULAR PUMP

[75] Inventor: Johan E. deRijke, Cupertino, Calif.

[73] Assignee: Ebara Technologies Incorporated, Santa Clara, Calif.

[21] Appl. No.: 225,049

[22] Filed: Apr. 8, 1994

[51] Int. Cl.[6] ..... B01D 8/00

[52] U.S. Cl. ..... 62/55.5; 415/90; 417/901

[58] Field of Search ..... 62/55.5; 417/901; 415/90

[56] References Cited

U.S. PATENT DOCUMENTS

| | | | |
|---|---|---|---|
| 3,536,418 | 10/1970 | Breaux | 417/49 |
| 4,718,240 | 1/1988 | Andeen et al. | 62/55.5 |
| 4,724,677 | 2/1988 | Foster | 62/55.5 |
| 4,757,689 | 7/1988 | Bächler et al. | 62/55.5 |
| 4,860,546 | 8/1989 | Harvell et al. | 62/55.5 |
| 4,910,965 | 3/1990 | Lepofsky et al. | 62/55.5 |
| 4,926,648 | 5/1990 | Okurmura et al. | 62/55.5 |
| 4,958,499 | 9/1990 | Haefner et al. | 417/901 |
| 5,001,903 | 3/1991 | Lessard et al. | 62/55.5 |
| 5,010,737 | 4/1991 | Okurmura et al. | 62/55.5 |
| 5,062,271 | 11/1991 | Okurmura et al | 62/55.5 |
| 5,231,839 | 8/1993 | deRijGe et al. | 62/55.5 |

FOREIGN PATENT DOCUMENTS

| | | |
|---|---|---|
| 9208894 | 9/1991 | WIPO . |
| 9205294 | 4/1992 | WIPO . |

*Primary Examiner*—Ronald C. Capossela
*Attorney, Agent, or Firm*—Stanley Z. Cole

[57] ABSTRACT

Methods and apparatus for partial regeneration of a cryopump are provided. The cyropump includes first and second stage cryoarrays, a refrigerator for cooling the first and second stage cryoarrays, and typically includes a sorbent material for removing gases by cryosorption. The second stage cryoarray is heated from its operating temperature to a partial regeneration temperature range selected to liberate captured gas from the second stage cryoarray and to retain condensed water vapor on the first stage cryoarray. The partial regeneration temperature range is preferably 100K to 160K and is more preferably 120K to 140K. When the second stage cryoarray has a temperature within the partial regeneration temperature range, gas liberated from the second stage cryoarray is pumped with a turbomolecular pump in fluid communication with the cryopump. The turbomolecular pump removes liberated gases from the cryopump at high speeds and produces a low pressure in the cryopump. As a result, the tendency for contamination of the sorbent material is low.

32 Claims, 4 Drawing Sheets

METHOD AND APPARATUS FOR CRYOPUMP REGENERATION USING TURBOMOLECULAR PUMP

FIELD OF THE INVENTION

This invention relates to cryogenic vacuum pumps and, more particularly, to methods and apparatus for cryopump regeneration using a turbomolecular pump.

BACKGROUND OF THE INVENTION

Cryogenic vacuum pumps (cryopumps) are widely used in high vacuum applications. Cryopumps are based on the principle of removing gases from a vacuum chamber by having them lose kinetic energy and then binding the gases on cold surfaces inside the pump. Cryocondensation, cryosorption and cryotrapping are the basic mechanisms that can be involved in the operation of the cryopump. In cryocondensation, gas molecules are condensed on previously condensed gas molecules. Thick layers of condensation can be formed, thereby pumping large quantities of gas.

Cryosorption is commonly used to pump gases that are difficult to condense at the normal operating temperatures of the cryopump. In this case, a sorbent material, such as activated charcoal, is attached to the coldest surface in the cryopump, typically the second stage cryoarray. The binding energy between gases and the adsorbing surface is greater than the binding energy between the gas particles themselves, thereby causing gas particles that cannot be condensed to adhere to the sorbent material and thus be removed from the vacuum system. When several monolayers of adsorbed gas have been built up, the effect of the adsorbing surface is lost and gas can no longer be pumped.

Cryopumps commonly have two stages. A two stage cryopump includes a first stage cryoarray, which typically operates at temperatures between 50K and 100K, and a second stage cryoarray, which typically operates at temperatures between 12K and 20K. A closed-loop helium refrigerator includes a two stage expander, which creates cryogenic refrigeration by the controlled expansion of compressed helium. The cryoarrays are thermally connected to the stages of the expander and are cooled by them.

Gases are pumped on three surfaces within the cryopump. The first stage cryoarray pumps gases, such as water vapor and carbon dioxide, at relatively high temperatures. These gases are pumped by cryocondensation. The top outside surface of the second stage cryoarray pumps gases, such as nitrogen, oxygen and argon, at the normal operating temperature of the second stage. The inside surfaces of the second stage cryoarray are coated with a sorbent material and pump the noncondensible gases hydrogen, neon and helium by cryosorption.

Under normal operating pressures, conditions of molecular flow exists in the cryopump. Practically all molecules entering the pump will strike the first stage cryoarray and the outside of the second stage cryoarray before reaching the sorbent material. Thus, all gases except hydrogen, neon and helium are pumped before reaching the sorbent material, keeping it free to pump those gases.

Finite amounts of gas can be accumulated on the pump surfaces before performance deteriorates and eventually becomes unacceptable. At this point, captured gases need to be released and expelled from the cryopump, thereby renewing the pumping surfaces for further service. This process, called regeneration, includes warming the cryopump until the captured gases evaporate. The gases are then removed from the cryopump through a pressure relief valve and/or are removed by a roughing pump. The cryopump is then cooled to its operating temperature and normal operation is resumed.

A key to optimum regeneration is to prevent the sorbent material used on the second stage cryoarray from becoming contaminated with previously pumped gases. A standard method for removing all captured gases, including condensed water vapor, without contaminating the sorbent material includes warming the cryopump to room temperature while purging it with a dry inert gas. To ensure that the sorbent material is not contaminated, the cryopump is purged for some time after reaching room temperature and then is pumped with a roughing pump. Since all captured gases are removed from the cryopump, this process is called full regeneration. Full regeneration typically takes more than two hours. During this time, the cryopump and the equipment to which it is attached are not operable.

To shorten regeneration time, a process called partial regeneration has been developed. In partial regeneration, only the gases pumped on the second stage cryoarray are removed. The cryoarrays are warmed to a temperature of 110K to 160K by flowing an inert gas, such as dry nitrogen, through the pump, by shutting off the refrigerator and/or by using electrical heaters. In this temperature range, all gases pumped on the second stage liquefy and evaporate. However, little or no condensed water vapor evaporates at these temperatures. One method for removing liquid and gas from the pump is through a one way valve, as described in PCT Publication Nos. WO92/05294 and WO92/08894. The cryopump is then pumped with a roughing pump and is cooled to normal operating temperature. Partial regeneration takes approximately 45 minutes.

The prior art partial regeneration process has difficulties. In order to complete partial regeneration in 45 minutes, the accumulated gas must be removed in less than 15 minutes. In many applications, such as sputtering, more than 500 standard liters of gas have been accumulated in the cryopump. Thus, the rate of gas removal must be high. This means that the pressure in the cryopump must be high. Conditions of viscous flow exist for several minutes, and large amounts of condensible gas, such as argon, nitrogen and oxygen, may reach the sorbent material under these conditions and be partially adsorbed. The amount of gas adsorbed depends on the type of gas, its pressure and the temperature of the sorbent material. For optimum results, the cryopump must be pumped to a low pressure while the sorbent material is at a relatively high temperature (greater than 120K), to minimize the amount of condensible gas remaining on the sorbent material when the pump is cooled down. Typically, the cryopump is pumped with a trapped rotary oil-sealed pump or a dry roughing pump. The speed of these pumps becomes low at pressures below 0.1 torr, particularly when connected to the cryopump through a roughing line of typical length and diameter. Also, the ultimate pressure of these roughing pumps is high, typically $10^{-3}$ to $10^{-4}$ torr, for the gases that are to be removed. This results in the potential for significant contamination of the sorbent material, and as much as 5% of its capacity can be lost per regeneration cycle.

The use of a roughing pump for the final stage of gas removal has disadvantages. Due to the low speed of the roughing pump at low pressures, it is difficult to remove the gas in a short time interval. Also, during gas removal, cryoarray temperatures must remain between 110K and 160K. It is difficult to maintain the heat flow balance in the cryopump for extended periods to keep cryoarray temperatures within these required limits.

SUMMARY OF THE INVENTION

According to one aspect of the present invention, a method for partial regeneration of a cryogenic pumping device is provided. The cryogenic pumping device includes first and second stage cryoarrays and a refrigerator for cooling the first and second stage cryoarrays. The second stage cryoarray typically includes a sorbent material for removing gases by cryosorption. The method for partial regeneration comprises the steps of heating the second stage cryoarray from its operating temperature to a partial regeneration temperature range selected to liberate captured gas from the second stage cryoarray and to retain condensed water vapor on the first stage cryoarray, and, when the second stage cryoarray has a temperature within the partial regeneration temperature range, pumping gas liberated from the second stage cryoarray with a turbomolecular pump in fluid communication with the cryogenic pumping device. The partial regeneration temperature range is preferably 100K to 160K and is more preferably 120K to 140K.

During pumping of gas with the turbomolecular pump, the temperatures of the first and second stage cryoarrays are regulated within the partial regeneration temperature range. When the pressure in the cryogenic pumping device reaches a predetermined level, the first and second stage arrays are cooled to their normal operating temperatures, and normal operation is resumed.

The turbomolecular pump removes liberated gases from the cryogenic pumping device at high speed and produces a low pressure in the cryogenic pumping device. As a result, the tendency for contamination of the sorbent material is reduced in comparison with prior art partial regeneration techniques.

The second stage cryoarray is typically heated by flowing an inert gas, such as nitrogen, through the cryogenic pumping device in a purge cycle. The second stage cryoarray can also be heated by cycling the refrigerator on and off, and/or by an electrical heater in thermal contact with the second stage cryoarray. While the first stage cryoarray is inevitably also heated, the primary purpose of the partial regeneration process is to remove captured gases from the second stage cryoarray. Gas liberated from the second stage cryoarray during the purge cycle can be released from the cryogenic pumping device through a pressure relief valve. The purge cycle is terminated before energizing the turbomolecular pump.

The method for partial regeneration can further include heating the housing of the cryogenic pumping device with a housing heater in thermal contact with the housing. The rate of evaporation of captured gases is increased by heating the housing.

According to another aspect of the invention, apparatus for vacuum pumping an enclosed chamber is provided. The apparatus includes a cryogenic pumping device having first and second stage cryoarrays and a refrigerator for cooling the first and second stage cryoarrays during an operating cycle, and a turbomolecular pump in fluid communication with the cryogenic pumping device for pumping gas liberated from the second stage cryoarray during a partial regeneration cycle in which the second stage cryoarray is maintained within a partial regeneration temperature range selected to liberate captured gas from the second stage cryoarray and to retain condensed water vapor on the first stage cryoarray. The second stage cryoarray typically includes a sorbent material for removing gases by cryosorption.

The apparatus preferably further includes means for heating the second stage cryoarray during the partial regeneration cycle from its operating temperature to the partial regeneration temperature range, means for activating the turbomolecular pump during the partial regeneration cycle when the second stage cryoarray has a temperature within the partial regeneration temperature range, and means for regulating the temperature of the first and second stage cryoarrays within the partial regeneration temperature range when the turbomolecular pump is pumping gas from the cryogenic pumping device during the partial regeneration cycle.

According to a further aspect of the invention, methods and apparatus for partial regeneration of a plurality of cryogenic pumping devices are provided. Apparatus in accordance with this aspect of the invention comprises a plurality of cryogenic pumping devices, each including first and second stage cryoarrays and a refrigerator for cooling the first and second stage cryoarrays, and a turbomolecular pump in fluid communication with each of the cryogenic pumping devices. Each of the cryogenic pumping devices is adapted to be in fluid communication with an enclosed chamber for removing gases during an operating cycle. The turbomolecular pump removes gas liberated from the second stage cryoarray of each of the cryogenic pumping devices during a partial regeneration cycle in which the second stage cryoarray is maintained within a partial regeneration temperature range selected to liberate captured gas from the second stage cryoarray and to retain condensed water vapor on the first stage cryoarray.

The apparatus preferably further includes a vacuum valve between each of the cryogenic pumping devices and the turbomolecular pump for selectively connecting each of the cryogenic pumping devices to the turbomolecular pump. The partial regeneration cycle is preferably performed simultaneously for each of the cryogenic pumping devices. Alternatively, the partial regeneration cycle can be performed at different times for each of the cryogenic pumping devices.

BRIEF DESCRIPTION OF THE DRAWINGS

For a better understanding of the present invention, reference is made to the accompanying drawings, which are incorporated herein by reference and in which.

DETAILED DESCRIPTION

Figure 1:
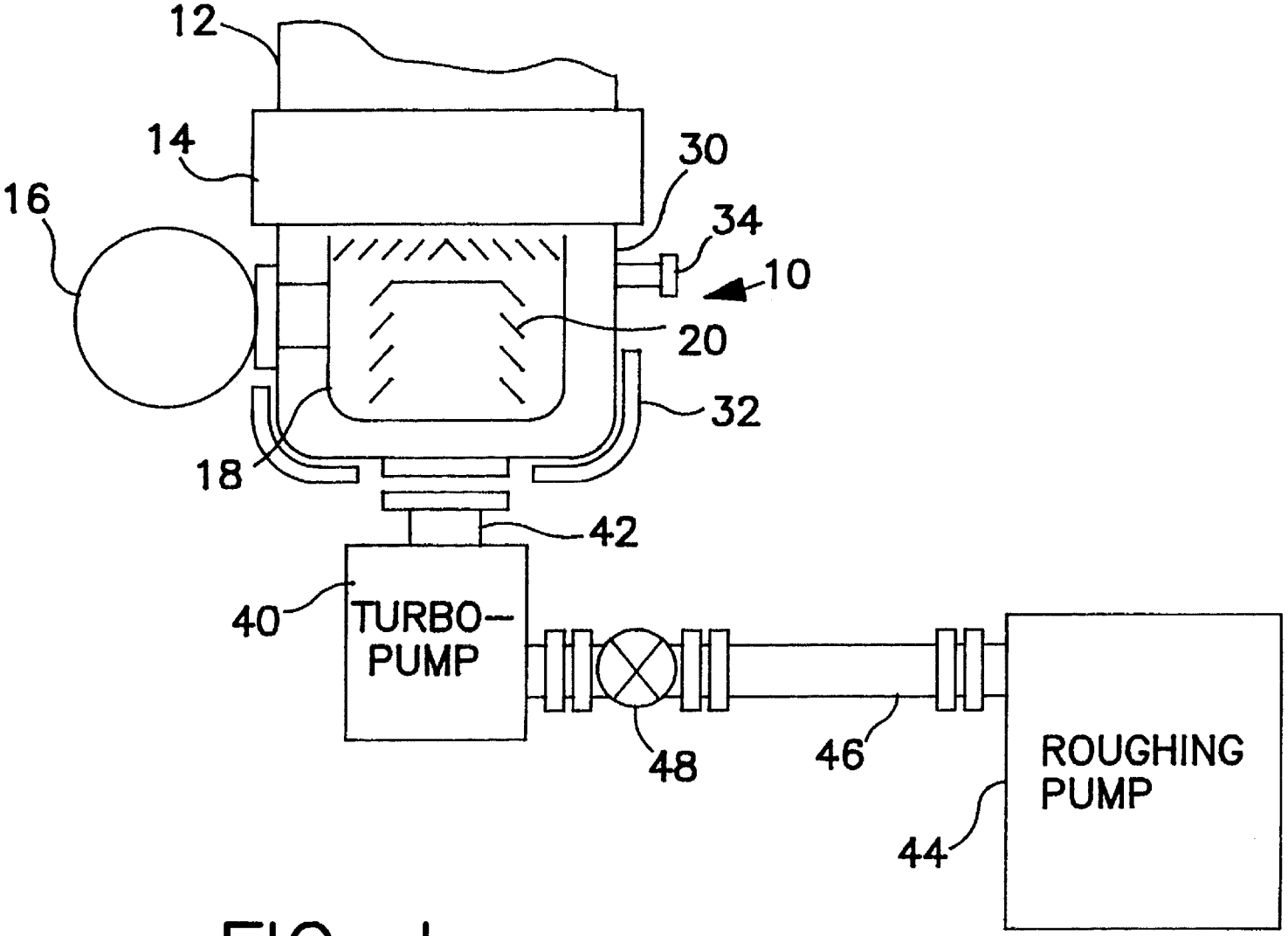
FIG. 1 is a schematic block diagram of vacuum pumping apparatus in accordance with the present invention.

A vacuum pumping apparatus in accordance with the present invention is shown in FIG. 1. A cryopump 10 has an inlet attached to a vacuum chamber 12 through a high vacuum valve 14. The vacuum chamber 12 (shown partially in FIG. 1) is capable of maintaining high vacuum and is typically used for performing vacuum processing of a workpiece. The cryopump 10 includes a refrigerator 16, typically a closed-loop helium refrigerator, in thermal contact with a first stage cryoarray 18 and a second stage cryoarray 20. The first stage cryoarray typically includes a baffle 22 which shields the second stage cryoarray 20 from the vacuum chamber 12. The second stage cryoarray 20 preferably includes a sorbent material, such as activated charcoal, on its inside surface for pumping of noncondensible gases by cryosorption. The construction of cryopumps is well known in the art and will not be described in detail. Cryopump 10 can be a standard, commercially available cryopump such as a Model FS-8LP, manufactured and sold by Ebara Technologies Inc., with the modifications described below.

The cryopump 10 includes a housing 30 which encloses the first stage cryoarray 18 and the second stage cryoarray 20, except for the opening to vacuum chamber 12. A housing heater 32 external to the vacuum region of cryopump 10 surrounds at least a portion of the housing 30 and is in thermal contact with housing 30. The housing heater can, for example, be a standard band heater. The housing heater is used during partial regeneration as described below. A pressure relief valve 34 is mounted in cryopump 10, typically in housing 30. The pressure relief valve 34 automatically opens when the pressure within cryopump 10 reaches a predetermined value, such as atmospheric pressure.

A turbomolecular vacuum pump (turbopump) 40 is connected through a conduit 42 to cryopump 10. A roughing pump 44 is connected to turbopump 40 through a roughing conduit 46 and a roughing valve 48. The turbopump 40 is used during partial regeneration as described below and may be used during normal operation. The roughing pump 44 is used for backup of the turbopump 40, since turbopumps are typically unable to exhaust to atmospheric pressure. Suitable turbopumps and roughing pumps are known in the art and are commercially available. For example, the turbopump 40 can be a Model ET 60, available from Ebara Technologies, Inc., and the roughing pump 44 can be a Model A10S, available from Ebara Technologies, Inc.

Figure 2:
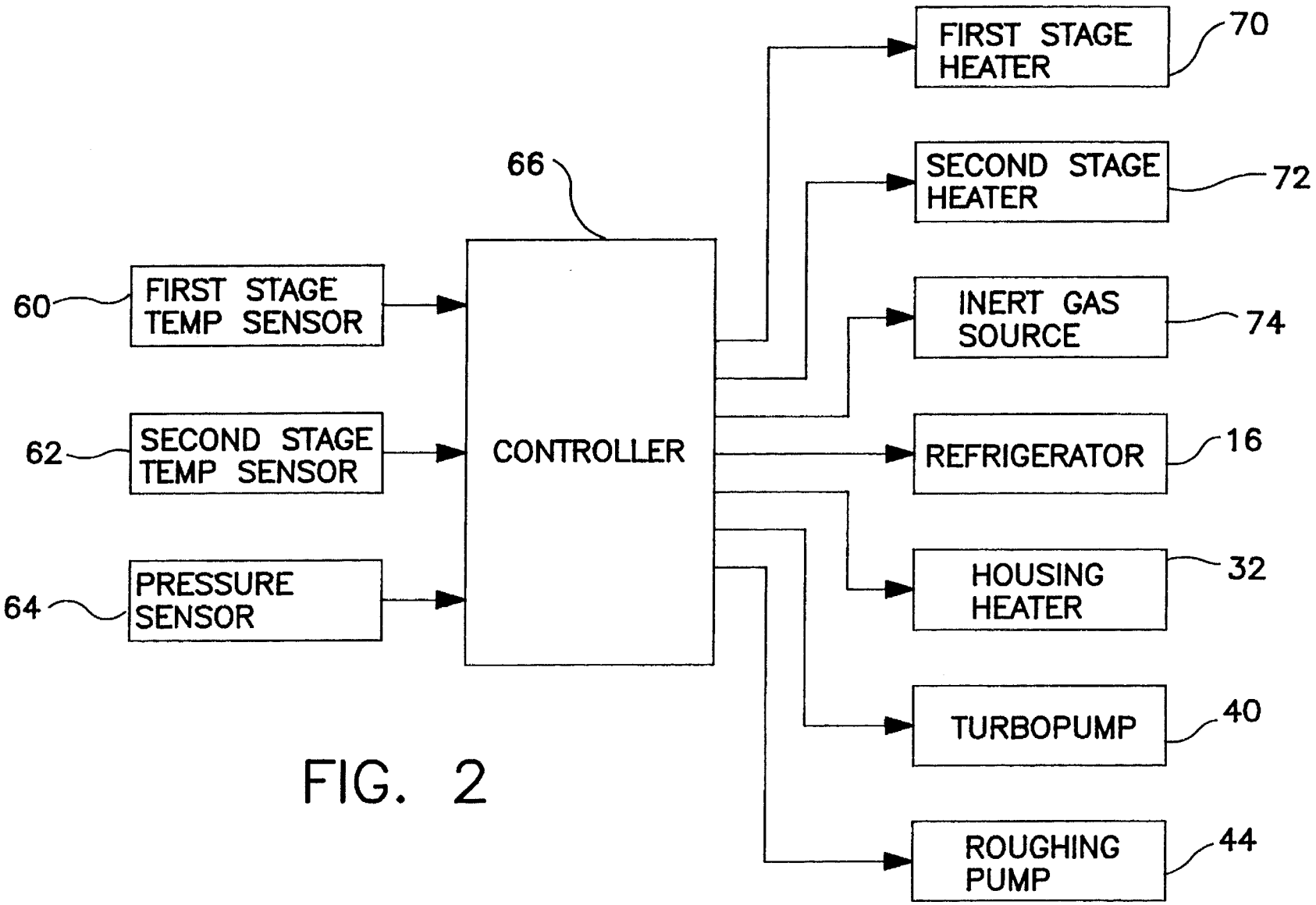
FIG. 2 is a block diagram of the control system for the vacuum pumping apparatus of FIG. 1.

The control system for the vacuum pumping apparatus of FIG. 1 is shown in FIG. 2. A first stage temperature sensor 60, a second stage temperature sensor 62 and a pressure sensor 64 supply input signals to a controller 66. The first and second stage temperature sensors 60 and 62 sense the temperature of the first and second stage cryoarrays 18 and 20, respectively. The pressure sensor 64 senses the pressure level within the cryopump 10. The controller 66 may be implemented as a microprocessor such as a type 83C152, available from Intel Corp. The controller 66 supplies control signals for energizing and deenergizing the refrigerator 16, the housing heater 32, the turbopump 40 and the roughing pump 44. In addition, the controller 66 energizes and deenergizes a first stage heater 70, which is in thermal contact with the first stage cryoarray 18, and a second stage heater 72, which is in thermal contact with the second stage cryoarray 20. Finally, the controller 66 controls an inert gas source 74. The inert gas source, which may be a nitrogen source, is connected to the cryopump 10 through a suitable conduit so as to permit a flow of the inert gas through the cryopump 10 during a purge cycle as described below.

The controller 66 controls operation of the vacuum pumping apparatus as described below. The overall operation includes a normal operating cycle and a partial regeneration cycle. During the normal operating cycle, the cryopump 10 removes gases from vacuum chamber 12 by cryocondensation and cryosorption as is known in the art. The partial regeneration cycle is used to remove captured gases from the cryopump 10 and may be initiated manually or automatically at predetermined intervals. The partial regeneration cycle is described in detail below.

During the normal operating cycle, the first stage cryoarray 18 operates at temperatures between 50K and 100K and pumps gases such as water vapor and carbon dioxide. The second stage cryoarray 20 operates at temperatures between 12K and 20K. The top outside surface of the second stage cryoarray pumps gases such as nitrogen, oxygen and argon. The sorbent material on the inside surface of the second stage cryoarray 20 pumps noncondensible gases such as hydrogen, neon and helium by cryosorption. After operation of the cryopump 10 for some time, large amounts of the above gases are captured on the pump surfaces, and regeneration is required to renew pump operation.

Figure 3:
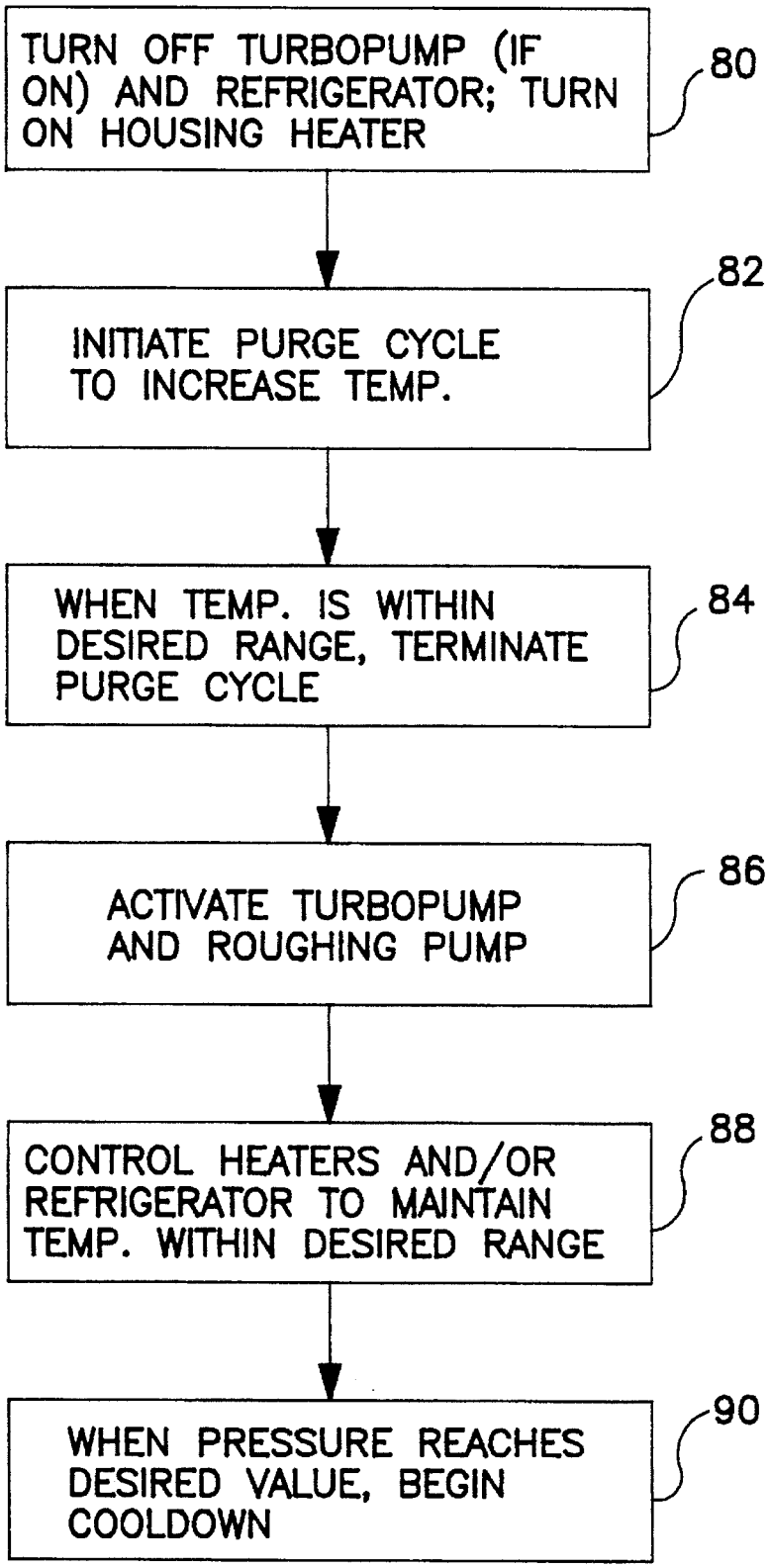
FIG. 3 is a flow chart that illustrates the partial regeneration process of the present invention.

A flow chart of the partial regeneration cycle, or process, in accordance with the present invention is shown in FIG. 3. As an initial step 80 of the partial regeneration cycle, the turbopump 40 and the roughing pump 44 are turned off if they have been in operation during the normal operating cycle. The turbopump 40 and the roughing pump 44 may or may not be used during the normal operating cycle to assist the operation of cryopump 10. However, the turbopump 40 and the roughing pump 44 should be turned off or otherwise deactivated during the purge cycle. In addition, the refrigerator 16 can be turned off, but is not required to be turned off during the purge cycle. Finally, the housing heater 32 is energized during the partial regeneration cycle. The housing heater 32 prevents the housing 30 from reaching low temperatures during the partial regeneration cycle and thereby prevents condensation of large amounts of water vapor on the outer surface of housing 30. As a result, heat transfer through the housing is more efficient, and the partial regeneration cycle can be completed in a shorter time.

In step 82, the purge cycle is initiated. The purge cycle involves causing a flow of an inert gas such as nitrogen, from the inert gas source 74 through the cryopump 10 at a controlled rate to produce controlled heating of the cryopump 10 and, in particular, heating of the second stage cryoarray 20. The control of the inert gas source 74 may, for example, involve control of a valve between gas source 74 and cryopump 10. The flow of inert gas is typically in a range of about 1 to 2 cubic feet per minute and causes heating of the surfaces within the cryopump 10. Specifically, the second stage cryoarray 20 is heated from its normal operating temperature of 12K to 20K to a predetermined partial regeneration temperature range. The partial regeneration temperature range is selected to liberate captured gas from the second stage cryoarray 20 and to retain condensed water vapor on the first stage cryoarray 18. The partial regeneration temperature range is preferably in a range of 100K to 160K and is more preferably in a range of 120K to 140K. Within this temperature range, captured gases evaporate from the second stage cryoarray 20. However, the temperature is low enough to insure that condensed water vapor does not evaporate from the first stage cryoarray 18. The captured gases typically begin boiling off the second stage cryoarray 20 when a temperature of about 70K is reached. This produces a rapid increase in pressure within cryopump 10, thereby causing the pressure relief valve 34 to open. The pressure relief valve 34 releases the gases liberated from the second stage cryoarray and also releases the inert gas that is introduced during the purge cycle.

The purge cycle is continued for a time on the order of 5 to 7 minutes, with the liberated gases being released through the pressure relief valve 34. When the temperature, as sensed by the first stage temperature sensor 60 and the second stage temperature sensor 62, is within the partial regeneration temperature range, preferably a temperature of about 130K, the purge cycle is terminated in step 84 by deactivating the inert gas source 74. During the purge cycle, heating of the cryopump 10 can be supplemented by the first stage heater and/or the second stage heater 72. Heating of the cryopump 10 can also be supplemented by deenergizing the refrigerator 16 during the purge cycle.

When the cryopump 10 has reached the desired partial regeneration temperature and the purge cycle has been terminated, the turbopump 40 and the roughing pump 44 are activated in step 86, typically by turning these devices on. The turbopump 50 reduces the pressure and reduces or eliminates convection within the cryopump 10, thereby slowing or stopping further temperature rise of the first and second stage cryoarrays 18 and 20.

Turbopump 40 is closely coupled to the cryopump 10 and has a high pumping speed, typically greater than 50 liters per second. Also, the turbopump 40 can reach a base pressure, typically less than $10^{-8}$ torr, that is many orders of magnitude lower than that of a rotary roughing pump. The residual gas is rapidly pumped away by the turbopump 40, and a low pressure is achieved in the cryopump 10 in a short time.

During the time the turbopump 40 is removing residual gas, the temperatures of the first and second stage cryoarrays are regulated in step 88 within the desired partial regeneration temperature range, preferably between 120K and 140K. Temperature regulation can be effected by turning the refrigerator 16 on and off and/or by switching the second stage heater 72 on and off, as required to maintain the desired temperature. The heaters 70 and 72 permit independent temperature control of the first and second stage cryoarrays 18 and 20, respectively.

When the pressure within the cryopump 10 reaches a desired value, preferably in the range of 1 millitorr to 50 millitorr, regulation of the temperature within the partial regeneration temperature range is discontinued in step 90 by turning off second stage heater 72 and housing heater 32. The refrigerator 16 is energized continuously, so that the cryopump 10 begins cooling toward its normal operating temperatures. The turbopump 40 can, if desired, remain in operation during the cooldown portion of the partial regeneration cycle and during the normal operating cycle. The turbopump 40 is typically on for about 10 minutes between the end of the purge cycle and the start of cooldown to normal operating temperatures. The time to cool down to normal operating temperatures is on the order of 30 minutes.

An advantage of the invention is that, due to the higher speed and throughput capability of the turbopump at the desired pressure range (between $10^{-1}$ and $10^{-5}$ torr) as compared to a rotary pump, the speed of condensible gas removal from the sorbent material on the second stage cryoarray 20 is improved by several orders of magnitude. Deterioration of noncondensible gas pumping capability by the sorbent material after partial regeneration is thereby significantly reduced or eliminated. Up to 10 partial regenerations have been performed under varying conditions with no measurable loss in hydrogen pumping capability.

Another advantage of the invention is that the cryopump 10 remains at high pressure for a much shorter time as compared with prior art partial regeneration techniques. Due to convection in the cryopump at high pressure, accurate control of both the first stage cryoarray and the second stage cryoarray temperatures is difficult. If the first stage temperature becomes too high, water vapor can evaporate from the first stage cryoarray 18 and be transported to the sorbent material. This contamination of the sorbent material by water vapor is significantly reduced by the ability of the turbopump 40 to rapidly remove gas to low pressures.

The housing heater 32 facilitates the rapid evaporation of cryogenic liquids. Typically, the housing 30 is a thin-walled, stainless steel cylinder. When argon liquefies, it migrates to the lower inside portion of the housing 30. Measurements show that the housing rapidly cools to temperatures of about −130° C. This causes condensation and the formation of ice on the outside of the housing 30. The combination of the condensate layer and the poor thermal conductance through the stainless steel wall limits the amount of heat flow necessary to evaporate the liquid argon. By providing housing heater 32 on the outside of the housing 30, heat flow is significantly improved. The liquid argon evaporates more rapidly and therefore is removed from the cryopump 10 more quickly, thereby shortening the time the cryoarrays must be kept at temperatures in the range of 110K to 160K and also improving the pump down time when the purge cycle is terminated and the turbopump 40 is lowering the internal pressure in the cryopump 10.

Figure 4:
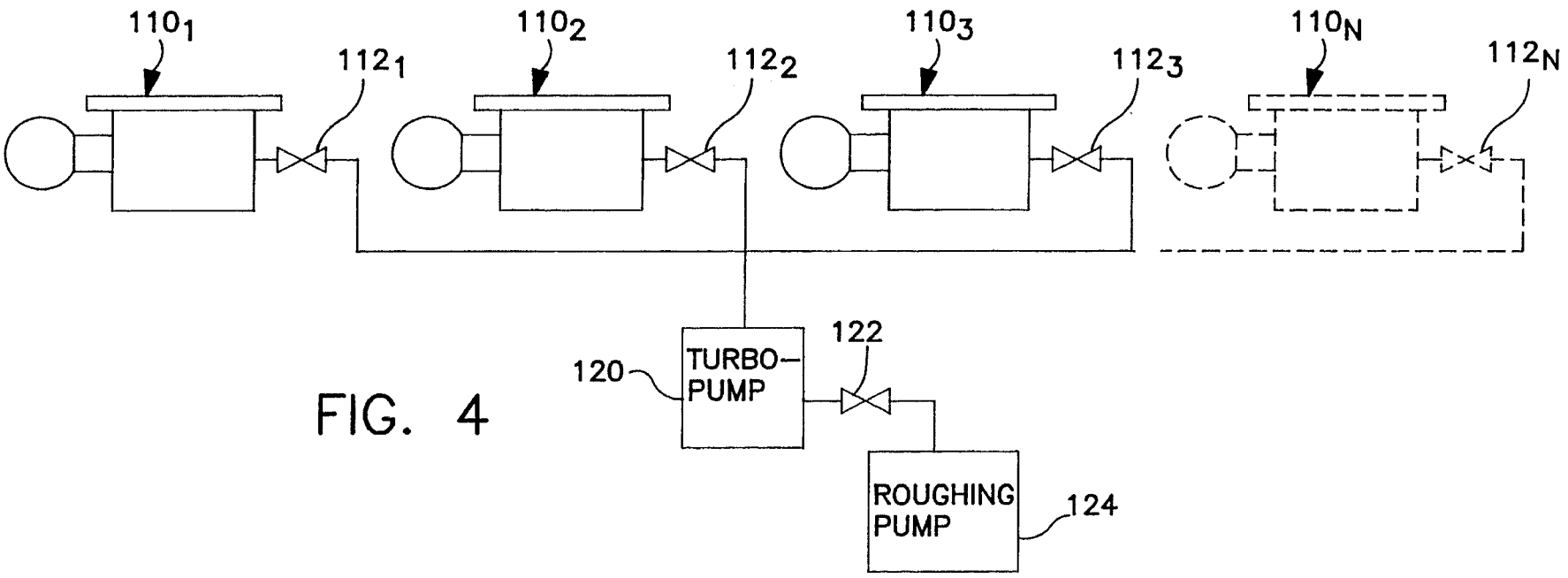
FIG. 4 is a block diagram of vacuum pumping apparatus in accordance with the present invention wherein a single turbopump is used for partial regeneration of two or more cryopumps.

A block diagram of vacuum pumping apparatus in accordance with the present invention wherein a single turbopump is used for partial regeneration of two or more cryopumps as shown in FIG. 4. Cryopumps $\mathbf{110}_1$, $\mathbf{110}_2$, $\mathbf{110}_3$, . . . $\mathbf{110}_N$ are connected through vacuum valves $\mathbf{112}_1$, $\mathbf{112}_2$, $\mathbf{112}_3$, . . . $\mathbf{112}_N$, respectively, to the inlet of a turbopump 120. The turbopump 120 is connected through a roughing valve 122 to a roughing pump 124. Each of the cryopumps $\mathbf{110}_1$, $\mathbf{110}_2$, $\mathbf{110}_3$, . . . $\mathbf{110}_N$ includes first and second stage cryoarrays and a refrigerator, and corresponds to the cryopump shown in FIG. 1 and described above. The turbopump 120 and the roughing pump 124 correspond to the turbopump 40 and the roughing pump 44 shown in FIG. 1 and described above.

In the vacuum pumping apparatus of FIG. 4, a single turbopump 120 is used for partial regeneration of two or more cryopumps. The partial regeneration process for the vacuum pumping apparatus of FIG. 4 corresponds to the process shown in FIG. 3 and described above. The partial regeneration of the cryopumps is preferably performed simultaneously to reduce system downtime, but may also be performed at different times. For simultaneous partial regeneration of two or more cryopumps, the turbopump 120 is selected to have sufficient capacity for removing gases from the desired number of cryopumps. The configuration shown in FIG. 4 has the advantage that only a single turbopump is required for partial regeneration in a system having multiple cryopumps, thereby reducing cost.

While there have been shown and described what are at present considered the preferred embodiments of the present invention, it will be obvious to those skilled in the art that various changes and modifications may be made therein without departing from the scope of the invention as defined by the appended claims.

What is claimed is:

1. Apparatus for vacuum pumping an enclosed chamber comprising:

a cryogenic pumping device having first and second stage cryoarrays and a refrigerator for cooling said first and second cryoarrays during an operating cycle, said pumping device adapted to be in fluid communication with the chamber for removing gases from the chamber during said operating cycle;

means for heating said second stage cryoarray, during a partial regeneration cycle, from its operating temperature to a partial regeneration temperature range selected to liberate captured gas from said second stage cryoarray and to retain condensed water vapor on said first stage cryoarray;

a turbomolecular pump in fluid communication with the cryogenic pumping device for pumping gas liberated from said second stage cryoarray during said partial regeneration cycle;

means for activating said turbomolecular pump during said partial regeneration cycle when said second stage cryoarray has a temperature within said partial regeneration temperature range; and means for regulating the temperature of said first and second stage cryoarrays within said partial regeneration temperature range when said turbomolecular pump is pumping gas from said cryogenic pumping device during said partial regeneration cycle.

2. Apparatus as defined in claim 1 wherein said partial regeneration temperature range is 100K to 160K.

3. Apparatus as defined in claim 1 where said partial regeneration temperature range is 120K to 140K.

4. Apparatus as defined in claim 1 where said means for heating said second stage cryoarray comprises means for causing a flow of inert gas through said cryogenic pumping device in a purge cycle.

5. Apparatus as defined in claim 4 further including means for terminating said purge cycle prior to activation of said turbomolecular pump.

6. Apparatus as defined in claim 1 further including a pressure relief valve for releasing gas from said cryogenic pumping device during said partial regeneration cycle, when the pressure in said cryogenic pumping device exceeds an activation pressure of said pressure relief valve.

7. Apparatus as defined in claim 1 wherein said means for regulating comprises an electrical heater in thermal contact with said second stage cryoarray and means for energizing said electrical heater.

8. Apparatus as defined in claim 1 wherein said means for regulating comprises means for regulating said refrigerator with a duty cycle selected to maintain said first and second stage cryoarrays within said partial regeneration temperature range.

9. Apparatus as defined in claim 1 wherein said second stage cryoarray includes a sorbent material for removing gases from the chamber by cryosorption.

10. Apparatus as defined in claim 1 further including means for initiating cooling of said cryogenic pumping device to its operating temperature when said turbomolecular pump has reduced the pressure in said cryogenic pumping device to a predetermined pressure level.

11. Apparatus as defined in claim 10 wherein said predetermined pressure level is in a range of 50 millitorr to 1 millitorr.

12. Apparatus as defined in claim 1 wherein said cryogenic pumping device includes a housing, and further including a housing heater in thermal contact with said housing for heating said housing during said partial regeneration cycle.

13. A method for partial regeneration of a cryogenic pumping device which includes first and second stage cryoarrays and a refrigerator for cooling said first and second stage cryoarrays, said method comprising the steps of:

heating said second stage cryoarray from its operating temperature to a partial regeneration temperature range selected to liberate captured gas from said second stage cryoarray and to retain condensed water vapor on said first stage cryoarray;

when said second stage cryoarray has a temperature within said partial regeneration temperature range, pumping gas liberated from said second stage cryoarray with a turbomolecular pump in fluid communication with the cryogenic device;

during the step of pumping gas, regulating the temperature of said first and second stage cryoarrays within said partial regeneration temperature range; and when the pressure in said cryogenic pumping device reaches a predetermined level, cooling said first and second stage cryoarrays to their normal operating temperatures.

14. A method as defined in claim 13 wherein said partial regeneration temperature range is 100K to 160K.

15. A method as defined in claim 13 wherein said partial regeneration temperature range is 120K to 140K.

16. A method as defined in claim 13 wherein the step of heating said second stage cryoarray includes causing a flow of inert gas through said cryogenic pumping device in a purge cycle.

17. A method as defined in claim 16 including the step of terminating said purge cycle before the step of pumping gas with said turbomolecular pump.

18. A method as defined in claim 13 further including the step of releasing gas that was liberated from said second stage cryoarray from said cryogenic pumping device through a pressure relief valve.

19. A method as defined in claim 13 wherein the step of regulating the temperature includes electrically heating at least said second stage cryoarray.

20. A method as defined in claim 13 wherein the step of regulating the temperature includes energizing said refrigerator with a duty cycle selected to regulate the temperature of said first and second stage cryoarrays within said partial regeneration temperature range.

21. A method as defined in claim 13 wherein said second stage cryoarray includes a sorbent material for removing gases by cryosorption.

22. A method as defined in claim 13 wherein the step of cooling said first and second stage cryoarrays includes energizing said mechanical refrigerator when said cryogenic pumping device reaches a pressure in a range of 50 millitorr to 1 millitorr.

23. A method as defined in claim 13 further including the step of heating a housing of the cryogenic pumping device with a housing heater in thermal contact with said housing.

24. Apparatus for vacuum pumping an enclosed chamber comprising:

a cryogenic pumping device having first and second stage cryoarrays and a refrigerator for cooling said first and second cryoarrays during an operating cycle, said pumping device adapted to be in fluid communication with the chamber for removing gases from the chamber during said operating cycle; and a turbomolecular pump for intermittent operation during removal of gases from said second stage and for simultaneous connection into fluid communication with the cryogenic pumping device for pumping gas liberated from said second stage cryoarray during a partial regeneration cycle in which said second stage cryoarray is maintained within a partial regeneration temperature range selected to liberate captured gas from said second stage cryoarray and to retain in a frozen condition condensed water vapor on said first stage cryoarray.

25. A method for partial regeneration of a cryogenic pumping device which includes first and second stage cryoarrays and a refrigerator for cooling said first and second stage cryoarrays, said method comprising the steps of:

heating said second stage cryoarray from its operating temperature to a partial regeneration temperature range selected to liberate captured gas from said second stage cryoarray and to retain in a frozen condition condensed water vapor on said first stage cryoarray;

when said second stage cryoarray has a temperature within said partial regeneration temperature range, connecting said turbo-molecular to said cryogenic pumping device, pumping gas liberated from said second stage cryoarray with a turbomolecular pump in fluid communication with the cryogenic pumping device; and when the pressure in said cryogenic pumping device reaches a predetermined level, cooling said first and second stage arrays and disconnecting said turbomolecular pump from fluid communication with said cryogenic pumping device.

26. Apparatus for vacuum pumping comprising:

a plurality of cryogenic pumping devices, each including first and second stage cryoarrays and a refrigerator for cooling said first and second cryoarrays, each of said cryogenic pumping devices adapted to be in fluid communication with an enclosed chamber for removing gases during an operating cycle; and a turbomolecular pump for intermittent operation during removal of gases from said second stages and for connection into fluid communication with each of said cryogenic pumping devices for pumping gas liberated from said second stage cryoarray during a partial regeneration cycle in which said second stage cryoarray is maintained within a partial regeneration temperature range selected to liberate captured gas from said second stage cryoarray and to retain in a frozen condition condensed water vapor on said first stage cryoarray.

27. Apparatus as defined in claim 26 further including a vacuum valve between each of said cryogenic pumping devices and said turbomolecular pump for selectively connecting each of said cryogenic pumping devices to said turbomolecular pump.

28. Apparatus as defined in claim 26 wherein said partial regeneration cycle is performed simultaneously for each of said cryogenic pumping devices.

29. Apparatus as defined in claim 26 wherein said partial regeneration cycle is performed at different times for each of said cryogenic pumping devices.

30. A method for partial regeneration of a plurality of cryogenic pumping devices, each of which includes first and second stage cryoarrays and a refrigerator for cooling said first and second stage cryoarrays, said method comprising the steps of:

heating the second stage cryoarray of each of said cryogenic pumping devices from its operating temperature to a partial regeneration temperature range selected to liberate captured gas from the second stage cryoarray and to retain in a frozen condition condensed water vapor on the first stage cryoarray; and when the second stage cryoarray of each of said cryogenic pumping devices has a temperature within said partial regeneration temperature range, pumping gas liberated from the second stage cryoarray with a turbomolecular pump adapted to periodically operate and periodically be placed into fluid communication with each of said cryogenic pumping devices during said period said pumping devices are in said partial regeneration temperature range.

31. A method as defined in claim 30 wherein the steps of heating and pumping are performed simultaneously for each of said cryogenic pumping devices.

32. A method as defined in claim 30 wherein the steps of heating and pumping are performed at different times for each of said cryogenic pumping devices.

* * * * *